United States Patent [19]

Lingle

[11] 4,044,511

[45] Aug. 30, 1977

[54] FASTENING MEANS FOR FRAMELESS INSULATING PANELS

[76] Inventor: Cleo M. Lingle, 1201 Montclair, Longview, Tex. 75601

[21] Appl. No.: 730,849

[22] Filed: Oct. 8, 1976

[51] Int. Cl.[2] ..... E04B 2/82; E04B 1/90

[52] U.S. Cl. ..... 52/127; 52/309.9; 52/583; 52/584; 52/593; 264/267; 403/8

[58] Field of Search ..... 403/6–8; 264/267; 52/406, 404, 593, 584, 127, 582, 587, 583, 309.9

[56] References Cited

U.S. PATENT DOCUMENTS

| | | | |
|---|---|---|---|
| 2,647,287 | 8/1953 | Jones | 52/582 |
| 3,285,635 | 11/1966 | Whelan | 52/584 X |
| 3,365,851 | 7/1968 | Cushman | 52/127 X |
| 3,369,334 | 2/1968 | Berg | 52/584 X |
| 3,392,497 | 7/1968 | Cushman | 52/584 X |
| 3,496,692 | 2/1970 | Melcher | 52/583 |

FOREIGN PATENT DOCUMENTS

| | | | |
|---|---|---|---|
| 1,526,601 | 4/1968 | France | 52/583 |
| 1,029,549 | 5/1958 | Germany | 52/584 |

*Primary Examiner*—Leslie Braun
*Attorney, Agent, or Firm*—D. Paul Weaver

[57] ABSTRACT

Foamed-in-place metal skin covered insulating panels for the walls of walk-in coolers, freezers and refrigerated warehouses having a fastening bar assembly encapsulated therein. The fastening bar assembly possesses opposite end male and female fastening means for positive and rigid coupling with like threaded means of adjacent wall panels. The male fastening means includes a lag screw and a unique retaining means for the screw which positions it for use while protecting it from contact with the foamed insulation during fabrication of the panel with the fastening bar assembly in place between jig fixtures. The less efficient, weaker and more costly cam locking means of the prior art is eliminated.

5 Claims, 7 Drawing Figures

FASTENING MEANS FOR FRAMELESS INSULATING PANELS

BACKGROUND OF THE INVENTION

Foamed-in-place metal skin covered insulating panels for walk-in refrigerators and refrigerated warehouses are known in the prior art including panels having built-in attaching or locking means to connect adjacent panels of an insulated wall. It is difficult to fabricate the panels with fastening bar assemblies in place between jig fixtures when the insulating foam, such as polyurethane foam, is introduced into the cavity formed by the metal skins and end jig fixtures. The problem is to keep the insulating foam from entering and fouling the operation of the panel connecting or locking means. Customarily in the prior art, an enclosed or shielded rotary cam lock or hook-type fastening assembly has been employed successfully. However, the deficiencies and comparative weakness of this form of fastener are recognized, and ideally, for the sake of simplicity, economy and maximum strength and security, a screw-threaded connecting or locking means for adjacent insulating panels has been sought, but heretofore has not been available on a production basis primarily because of difficulties in installing the screw-threaded means within a foamed in-place panel. The particular problem which has been successfully solved by the invention is to protect the screw-threads of the fastener means from being fouled with the insulating foam during the fabrication of the panels.

The invention solves or overcomes this difficult problem by providing a simple and ingenious retaining and shielding means for the male lag screw at one end of the fastening bar assembly and by plugging the female threaded coupling member at the other end of the assembly during the foaming operation. The resulting panel construction, in terms of its built-in locking or fastening means, is far superior to the prior art, both in terms of strength or security and in economy of manufacture. Adjacent panel sections of an insulated wall can be drawn together and secured much more tightly and positively by the threaded means of the invention than by the prior art cam-type locking means. The essential method of forming the insulated panels is not interfered with in the slightest by the use of the invention.

Other features and advantages of the invention will be recognized by those skilled in the art during the course of the following detailed description.

DETAILED DESCRIPTION

Figure 1:
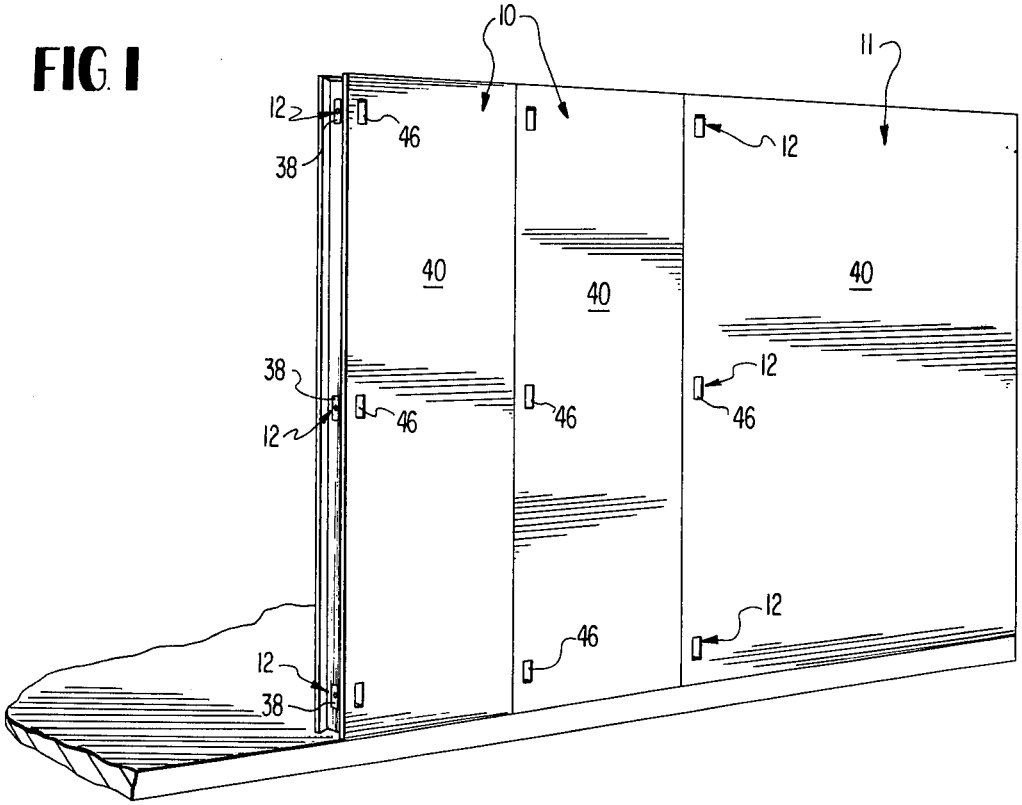
FIG. 1 is a partial perspective view of a wall section constructed from frameless foamed-in-place insulating panels equipped with the improved screw-threaded attaching or locking means of the invention.

Referring to the drawings in detail, wherein like numerals designate like parts, attention is directed first to FIG. 1 showing a partial wall for a walk-in refrigerator or the like formed from a pair of relatively narrow insulating panels 10 according to the invention and one comparatively wide panel 11. In practice, the narrow panels 10 are 22½ inches wide and the panel 11 is 45 inches wide, although these dimensions can be varied under the invention and are illustrative only and should not be taken in a limiting sense. The panels 10 and 11 are securely and rigidly connected in vertical edge-to-edge assembled relationship by the locking or attaching means forming the subject matter of the invention and involving the locking bar assembly 12 shown in FIG. 3, as well as in the other drawing figures. The assemblies 12 are installed in the panels 10 and 11 during the fabrication of the panels, to be described, in suitable vertically spaced relationship to form a very secure connection between the wall panels. The spacing of the connecting or locking means may be varied under the invention depending upon the heights of the structures and other factors, and the arrangement in FIG. 1 is illustrative only.

Figure 2:
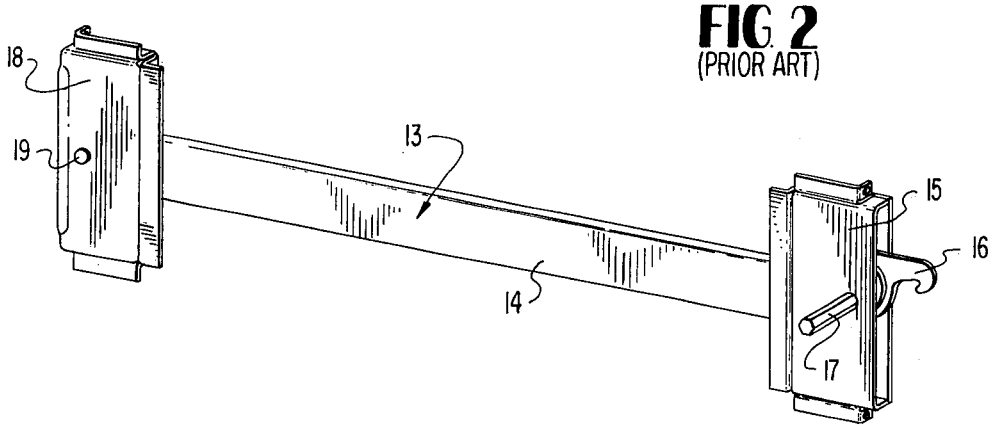
FIG. 2 (PRIOR ART)
FIG. 2 is a perspective view of a prior art panel locking means which the invention replaces.

FIG. 2 shows a prior art type of locking bar assembly 13 which the invention replaces. The assembly 13 includes a bar body portion 14 carrying at one end a support and housing 15 for a cam lock hook 16 having a wrench-engageable turning shaft 17 projecting from one side of the housing. A similar housing 18 is carried by the opposite end of the bar 14 and has a cross pin element 19 to coact in a known manner with the hook 16 of the next adjacent panel. Rotation of the hook 16 causes it to engage the element 19 of the next assembly and further rotation causes the two panels to be drawn together and locked in assembled relationship.

While the present invention as detailed in FIGS. 3 through 7 accomplishes broadly the same purpose, the improved assembly 12 employing screw-threaded connecting means is far mor positive and secure than the prior art in terms of the satisfactory joining of panels in assembled relationship.

Inasmuch as each panel locking or attaching assembly is identical to all other assemblies in the system, a full detailed description of one will suffice to describe all under the invention.

Referring now to FIGS. 3 through 7, the prefabricated locking bar assembly 12 comprises a sturdy sheet metal channel body 20 to which are anchored preferably by spot welding, near the longitudinal center of the channel body 20, a pair of opposing Z-shaped anchor elements 21 which assist in stabilizing the bar assembly in the mass of foam insulation which surrounds the bar assembly 12 in the completed insulating panel 10 or 11.

At one end of the channel body 20, a pair of sturdy angle brackets 22 are fixedly secured preferably by spot welding to opposite faces of the main web of channel body 20. The laterally projecting flanges of the angle brackets 22 which extend from opposite sides of the channel body 20 serve to mount fixedly thereon by screws 23 a female threaded coupling head or member 24 preferably in the form of a casting. The coupling head 24 has a base flange 25 seated on the outer faces of angle brackets 22 and the flange is apertured to receive the mounting screws 23.

At its opposite end away from the threaded coupling head 24, a transverse approximately U-shaped channel bracket 26 has its base 27 spot welded to the main web of channel body 20 between the shallow side flanges 28 thereof. Within the channel bracket 26 is a lag screw housing or shield 29 having an arched central portion forming a tunnel for the threaded shank 30 of a lag screw having a hex head 31. The shield further includes flat plate extensions 32 on opposite sides of the arched portion which are secured by spot welding to the base 27 of channel bracket 26, the latter extending for the full distance between the side flanges 28 of channel body 20.

A box consisting of opposed interfitting box halves 33 having overlapping flanges 34 for added rigidity and resistance to collapse under the pressure of expanding insulating foam has its bottom wall 35 spot welded to the main web of channel body 20. The end of the box formation away from the main web 20 is open to allow access to the head 31 of the lag screw for tightening the screw from the exterior of one side of the completed panel, to be further described. One half section 33 of the box is in contact with the adjacent side of channel bracket 26, as shown in the drawings. These two elements are apertured as at 36, FIG. 4, to receive the shank of the lag screw 30 and the opposite side of channel bracket 26 has a larger aperture 37 formed therethrough to facilitate alignment of the lag screw during the panel connecting operation, to be described.

It can be seen that the box formed by the half sections 33 and the adjacent channel bracket 26 and arched shield 29 form a locating and retaining means for the otherwise loose lag screw 30 prior to its use in attaching or locking adjacent wall panels. Preferably, the outer side wall of the channel bracket 26 is covered with paper masking tape 38, FIG. 4, across the enlarged aperture 37 to retain the screw 30 in the retracted inactive position shown in the drawings until such time as the screw is utilized to connect two panels. At such time, the pointed lag screw 30 can easily be thrust through the masking tape 38 and extended to the use position where it can engage within the threaded bore 39 of the adjacent female coupling head 24.

This completes the description of the locking bar assembly 12 per se.

Figures 3, 4, 5:
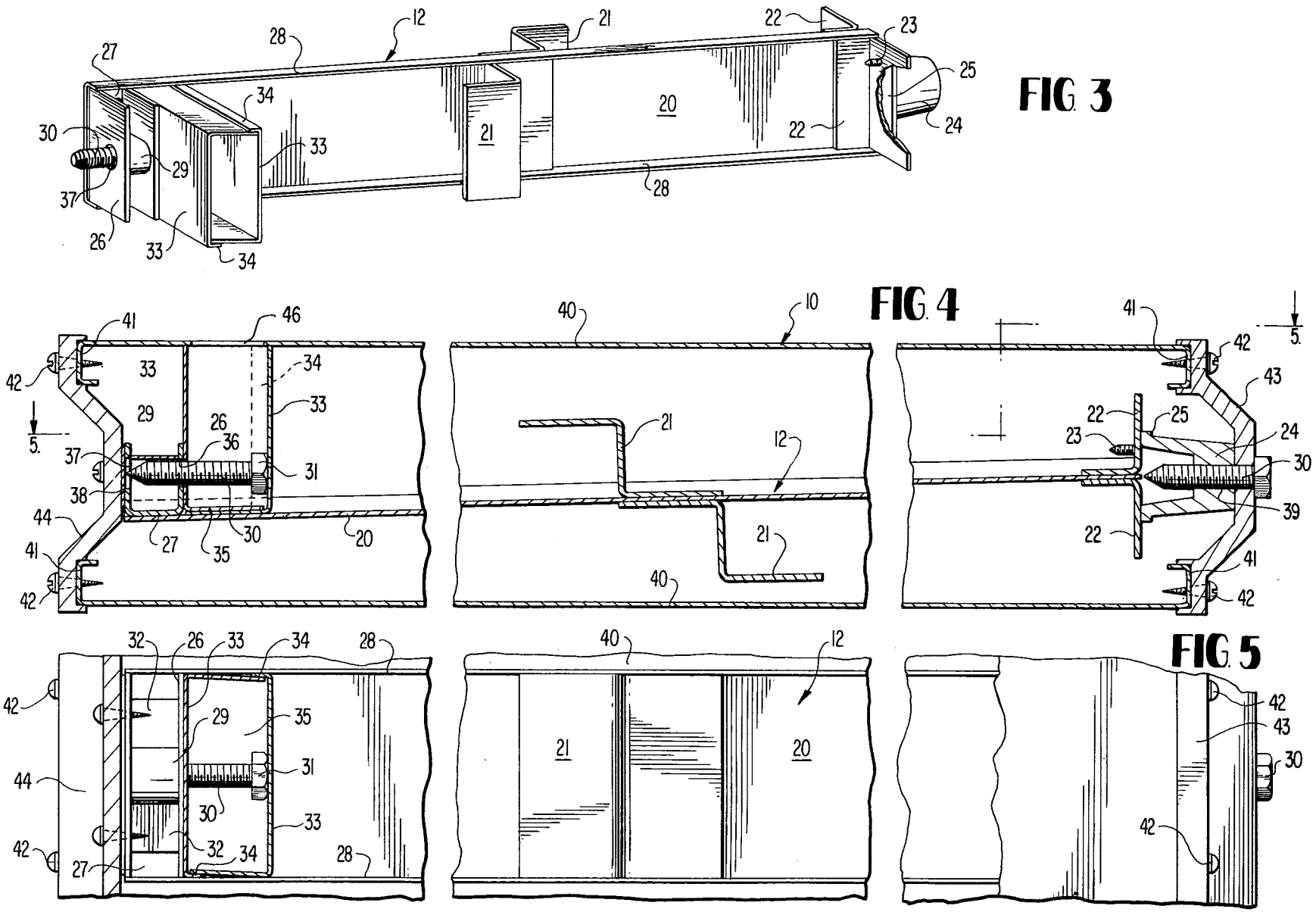
FIG. 3 is a perspective view of a locking bar assembly embodying the invention and possessing screw-threaded coupling or fastening components.
FIG. 4 is a fragmentary horizontal cross section taken through the locking bar assembly in association with a pair of metal panel skins and temporary frame members in the form of male and female jig fixtures prior to filling the panel cavity with polyurethane foam.
FIG. 5 is a fragmentary vertical section taken on line 5—5 of FIG. 4.
Figure 6:
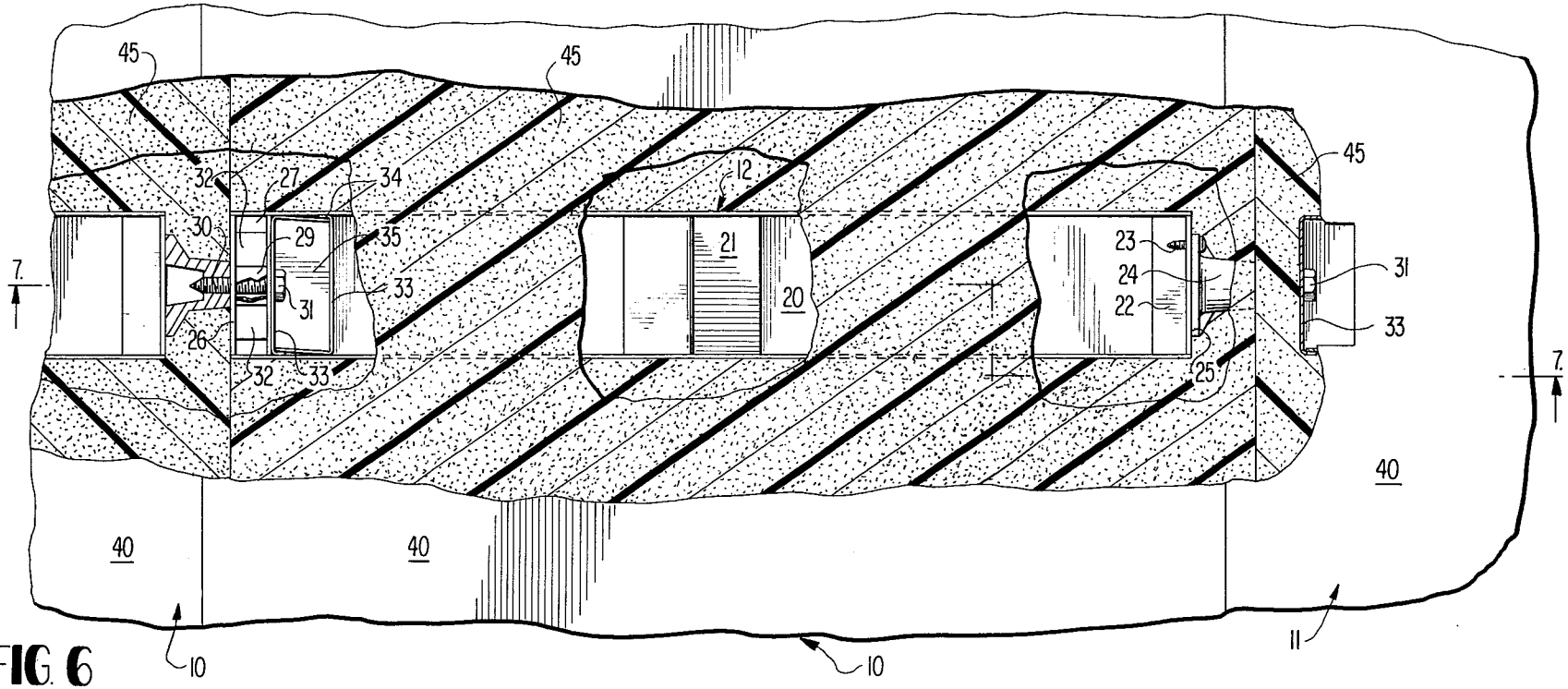
FIG. 6 is a side elevational view, partly in section and partly broken away, showing several polyurethane foam filled insulating panels connected by locking bar assemblies embodying the invention after removal of the end jig fixtures.
Figure 7:
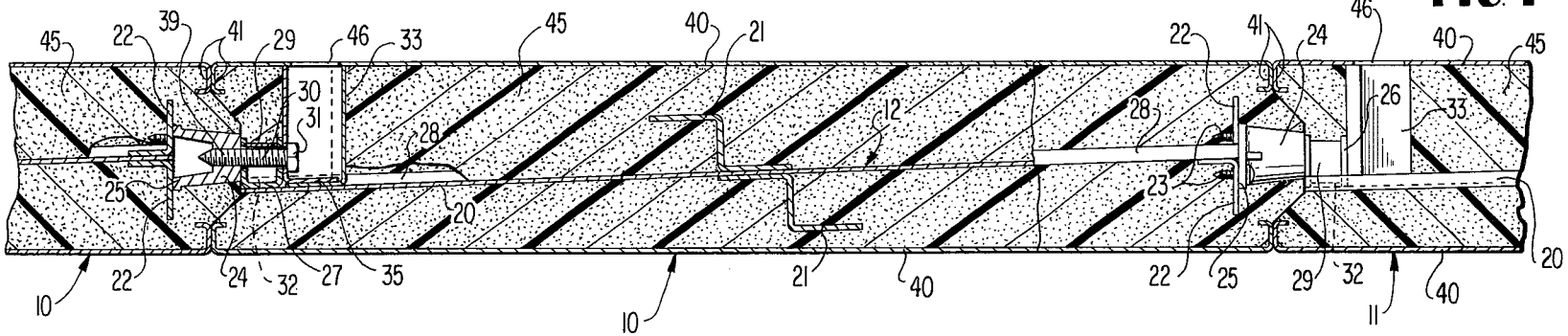
FIG. 7 is a horizontal section taken on line 7—7 of FIG. 6.

In the formation of any of the panels 10 or 11, FIGS. 4 and 5, by conventional practice, spaced parallel opposing sheet metal skins 40 or facings have their end flanges 41 coupled by screws 42 to male and female jig fixtures 43 and 44 which form temporary frame ends for the foamed-in-place insulating panels during their fabrication. Subsequently, the jig fixtures 43 and 44 are removed from the completed wall panels, after curing of the foam, and the metal skins 40 as well as the entire locking bar assembly 12 are permanently integrally attached to the insulating foam core 45 of each panel. In fact, as shown in FIGS. 6 and 7, the assembly 12 is entirely embedded, enclosed and concealed in the polyurethane foam core 45, and following removal of the fixtures 43 and 44 the outer side wall of channel bracket 27 carrying the masking tape 38 is at the recessed end face of the female edge of the wall panel while the outer end face of threaded coupling head 24 is flush with the protruding part of the male edge of the panel. The finished insulating panel 10 or 11 thus formed is frameless in accordance with modern practice with the opposite sides of the rigid foam core covered and protected by the metal skins 40.

As shown in the drawings, one of the metal skins 40 has a rectangular opening 46 in registry with the mouth of the described box structure. The box structure, in addition to providing access to the head of the lag screw 30 through the opening 46 with a wrench, prevents the insulating foam from contacting the lag screw during the foaming procedure which would foul the screw so that it could not operate. The interior of the box is free of foam at all times. The shield 29 also protects the lag screw from contact with the foam which is under considerable pressure. Following erection of a wall by means of the invention and when the panels are fully secured in assembled relationship, the protective boxes 33—33 may be filled or plugged with a section of foam and each aperture 46 may be closed with a plastic snap cap or the like for appearance sake. These plugs and caps are omitted from the drawings for clarity of illustration.

During the fabrication of a panel 10 or 11, FIGS. 4 and 5, one of the lag screws 30 is utilized to temporarily anchor the female coupling head 24 to the jig fixture 43 so that the assembly 12 will be held fixedly during the foaming-in-place procedure to produce the panel. This screw 30 is removed later along with the fixture 43.

It will be noted that the elements 21 are embedded and anchored within the rigid foam core 45 of the completed panel which further stabilizes and fixes the locking bar assembly 12 in the panel.

In light of the above description, the procedure for attaching and locking the panels 10 and 11 in assembled relationship in a wall is substantially apparent. Nevertheless, referring to FIGS. 1, 6 and 7, the male and female molded edges of adjacent frameless panels are brought together, and at each fastening and locking location, a wrench is inserted through the adjacent opening 46 to engage the lag screw head 31 and turn it. Prior to this, the point of the lag screw is thrust through the tape barrier 38 and the screw may be aligned by use of the fingers with the adjacent bore 39 of the female coupling head 24 of the next panel. The enlarged opening 37 facilitates screw alignment, as stated. The lag screw 30 is then tightened completely with the wrench to draw the interfitting male and female panel edges into tight assembled engagement, and the resulting joint is greatly superior in terms of security and absence of play to that provided by the prior art means of FIG. 2.

The feature of the tape 38 to prevent premature extension of the screw 30 from the opening 37 is important. If the screw were allowed to extend prematurely, it could be damaged in the assembling process and possibly an entire panel would be ruined because the lag screw 30 is captive within the retaining and protecting means 29 and 33 and cannot be removed. This is also an advantage in that the lag screws cannot be separated from the assembly 12 and lost prior to usage.

The advantages of the invention will now be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A locking bar assembly adapted for embedment bodily in the foam insulation core of a frameless metal faced structural panel adapted to be joined in edge-to-edge assembled relationship with other panels, said assembly comprising a bar body portion, mounting bracket means secured to one end of the bar body portion, a female threaded coupling element secured to the mounting bracket means, a male screw shielding and retaining means secured to the other end of the bar body portion and defining an access passage, and a male screw coupling element held loosely within said shielding and retaining means and adapted to be manipulated from within the access passage to project the male screw coupling element beyond the adjacent end of the bar body portion for rotational engagement with a female threaded coupling element of a like locking bar assembly of another panel, said shielding and retaining means comprising a box formation on the bar body portion projecting away from one side thereof and having an open end defining an entrance to said access passage, one side wall of the box formation having a clearance opening for the shank of said male screw coupling element, said shielding and retaining means additionally comprising an arched shield for the shank of the male screw coupling element at one side of the box formation and being secured to said bar body portion, a transverse channel bracket secured to the bar body portion and containing said arched shield and having side wall openings receiving said shank which are coaxial with said clearance opening of said box formation, and a puncturable sheet material element on the outer side wall of said channel bracket covering the adjacent side wall opening and blocking premature extension of said male screw coupling element beyond the adjacent end of the locking bar assembly.

2. A structural frameless metal faced insulating foam filled panel for walk-in refrigerators, refrigerated warehouses and the like, comprising a panel body portion formed of insulating foam and having male and female opposite end configurations, metal facings covering the opposite sides of said body portion, a locking bar assembly embedded bodily in said body portion and extending between said male and female opposite end configurations, said locking bar assembly comprising a bar body, a female threaded coupling secured to one end of the bar body and having a threaded bore opening through the male end configuration, a box formation secured to one side of the bar body near and spaced inwardly of its other end and extending away from said one side of the bar body and having an open end substantially flush with one metal facing of the panel, said one metal facing having an opening in registration with the open end of the box formation to allow access to the interior thereof, a lag screw enclosing and shielding means secured to said one side of the bar body between the box formation and said female end configuration and having a lag screw opening, one wall of said box formation having a lag screw opening in registration with the last-named opening, and a lag screw loosely engaged through said lag screw opening and having a head disposed captively in the box formation and being accessible therein for tightening the lag screw into threaded engagement with a female threaded coupling element of a next adjacent panel.

3. A structural frameless metal faced insulating foam filled panel as defined in claim 2, and said box formation comprising a pair of opposed interfitting channel members each having one long and one short side wall and each having a bottom wall, the bottom walls being superposed to provide a double thickness wall at the bottom of the box formation, and the double thickness wall being welded to said one side of the bar body, whereby the box formation is rendered very rigid for resisting crushing forces.

4. A structural frameless metal faced insulating foam filled panel as defined in claim 3, and said lag screw enclosing and shielding means comprising a channel cross section bracket having a bottom wall welded to said one side of the bar body and having spaced parallel side walls projecting away from said one side of the bar body with one side wall substantially abutting a side of the box formation, the first-named lag screw opening being formed through said side walls of the channel cross section bracket, and a roofed shielding element secured to the bottom wall of said channel cross section bracket and extending around the top sides of said lag screw when the lag screw is engaged in the first and second named lag screw openings.

5. A structural frameless metal faced insulating foam filled panel as defined in claim 4, and a frangible sheet element on the outer side wall of said channel cross section bracket covering the first-named leg screw opening, whereby the point of the lag screw is initially retained within the confines of the channel cross section bracket and the head of the lag screw is retained near the far side of said box formation relative to said bracket.

* * * * *